United States Patent [19]

Lorenzelli et al.

[11] Patent Number: 4,643,328

[45] Date of Patent: Feb. 17, 1987

[54] DEVICE FOR THE TIGHT CONNECTION OF TWO ENCLOSURES

[75] Inventors: Robert Lorenzelli, Saint-Remy-Les-Chevreuses; Pierre Dabernard, Gif Sur Yvette; Christian Maire, Bures-sur-Yvette, all of France

[73] Assignee: Cogema, Compagnie Generale des Matieres Nucleaires, Velizy Villacoublay, France

[21] Appl. No.: 799,867

[22] Filed: Nov. 21, 1985

[30] Foreign Application Priority Data

Nov. 26, 1984 [FR] France ..... 84 17967

[51] Int. Cl.[4] ..... B65D 51/18

[52] U.S. Cl. ..... 220/256; 220/315; 220/323

[58] Field of Search ..... 220/256, 260, 315, 318, 220/323

[56] References Cited

U.S. PATENT DOCUMENTS

| | | | |
|---|---|---|---|
| 4,140,240 | 2/1979 | Phatts | 220/323 |
| 4,580,694 | 4/1986 | Hempelmann et al. | 220/256 |

FOREIGN PATENT DOCUMENTS

| | | |
|---|---|---|
| 3201467 | 7/1983 | Fed. Rep. of Germany . |
| 1539845 | 9/1968 | France . |
| 2040616 | 1/1971 | France . |
| 2120085 | 8/1972 | France . |

*Primary Examiner*—George T. Hall

[57] ABSTRACT

The device is applicable to the connection of two enclosures, each having a door closing and opening formed in a flange. One of the doors supports a rotary control member having three series of slots forming cams. V-shaped levers articulated to the doors simultaneously cooperate with slots and with the bolts in order to displace the latter between locking and unlocking positions under the action of rotating the member. The configuration of the slots makes it possible to control the locking of the doors to one another and to the flanges in a sequential manner. Preferably, the bolts are inclined in the direction aiding sealing.

4 Claims, 3 Drawing Figures

DEVICE FOR THE TIGHT CONNECTION OF TWO ENCLOSURES

BACKGROUND OF THE INVENTION

The present invention relates to a device permitting the tight connection of two confinement enclosures, in order to transfer products, materials or equipment between said enclosures, whilst maintaining their confinement with respect to the external atmosphere.

Devices of this type are used in numerous industrial fields and in research, whenever it is necessary to isolate a given zone within a confinement enclosure, either due to the dangerous or contaminating nature of the atmosphere or products contained in this zone, or because the sterile atmosphere contained in said zone could be contaminated by the ambient air. Such situations more particularly occure in the nuclear, pharmaceutical and medical fields.

French Pat. No. 2040616 illustrates a tight double door transfer device formed by two doors, which close two openings respectively formed in each of the enclosures, within a flange integral with the wall of the corresponding enclosure. The doors and flanges are constructed in such a way that with the flanges engaged on one another, the two doors can be joined to form a double door, whose opening links the internal volumes of each of the enclosures. These devices also have annular sealing joints or gaskets respectively mounted on the door of one of the enclosures and on the flange of the other enclosure. These joints are positioned in such a way that the putting into operation of the device takes place without the external atmoshere trapped between the two doors communicating with the internal atmosphere of the enclosures and without the opening of the double door having the effect of breaking the seal between the internal atmosphere of the enclosures and the external atmosphere.

In the existing connecting devices and as illustrated by the aforementioned patent, the closing of each of the doors is usually carried out by a bayonet mechanism. Such a mechanism imposes a rotation of the doors both during there opening and during there closing. During at least part of this rotation, the annular sealing joints rub against the metal surface to which they are normally applied when the doors are closed. As the material forming the joints is an elastomer material, this rubbing has the effect of damaging the surface and consequently the seal. These disadvantages are increased when the device is subject to systematic handlings, as is particularly the case when it is inserted in an installation requiring frequent manipulations.

SUMMARY OF THE INVENTION

The object of the present invention is a device for the tight connection of two enclosures not suffering from the disadvantages of the known devices and which can be systematically used in large installations, said device being able to withstand without damage high axial forces.

The present invention specifically relates to a device for the tight connection of a first enclosure having a first flange forming an opening normally closed by a first door to a second enclosure having a second flange forming an opening normally closed by a second door, said device having means for locking the doors to the flanges and the doors to one another, wherein the locking means comprise at least one control member supported in a rotary manner by the first door and having at least three cam surfaces; a first set of at least three bolts and a second set of at least three bolts able to slide in the first door between a retracted position and a locking position in which said bolts project into recesses respectively formed in the first flange and in the second door; a third set of at least 3 bolts able to slide in the second door between a retracted position and a locking position in which said third set of bolts projects into a recess formed in the second flange; and three sets of at least three transmission members respectively placed between each cam surface and one of the sets of bolts for moving the latter between there retracted and locking positions under the effect of a rotation of the control member.

According to a particularly interesting embodiment of the invention, each of the bolts is mobile in a direction located in a plane containing the rotation axis of the control member and inclined in the direction aiding the sealing of the doors. Preferably, each of the transmission members comprises a v-shaped lever articulated about an axis orthogonal to the rotation axis of the control member and whereof one end bears on one of the cam surfaces and whereof the opposite end bears on one of the bolts, the levers bearing on the first and second sets of bolts being articulated on the first door, whilst the levers bearing on the third set of bolts are articulated on the second door.

According to another feature of the invention, one of the flanges, called the external flange, is extended around the flange, called the internal flange, the device also having means for locking the flanges together, said means having at least one fourth set of at least three bolts able to slide in the external flange between a retracted position and a locking position in which the fourth set of bolts projects into a recess formed in the internal flange, and means for displacing said fourth set of bolts between its retracted position and its locking position.

BRIEF DESCRIPTION OF THE DRAWINGS

The invention is described in greater detail hereinafter relative to non-limitative embodiments and the attached drawings, wherein show.

DETAILED DESCRIPTION OF THE PREFERRED EMBODIMENTS

Figure 1:
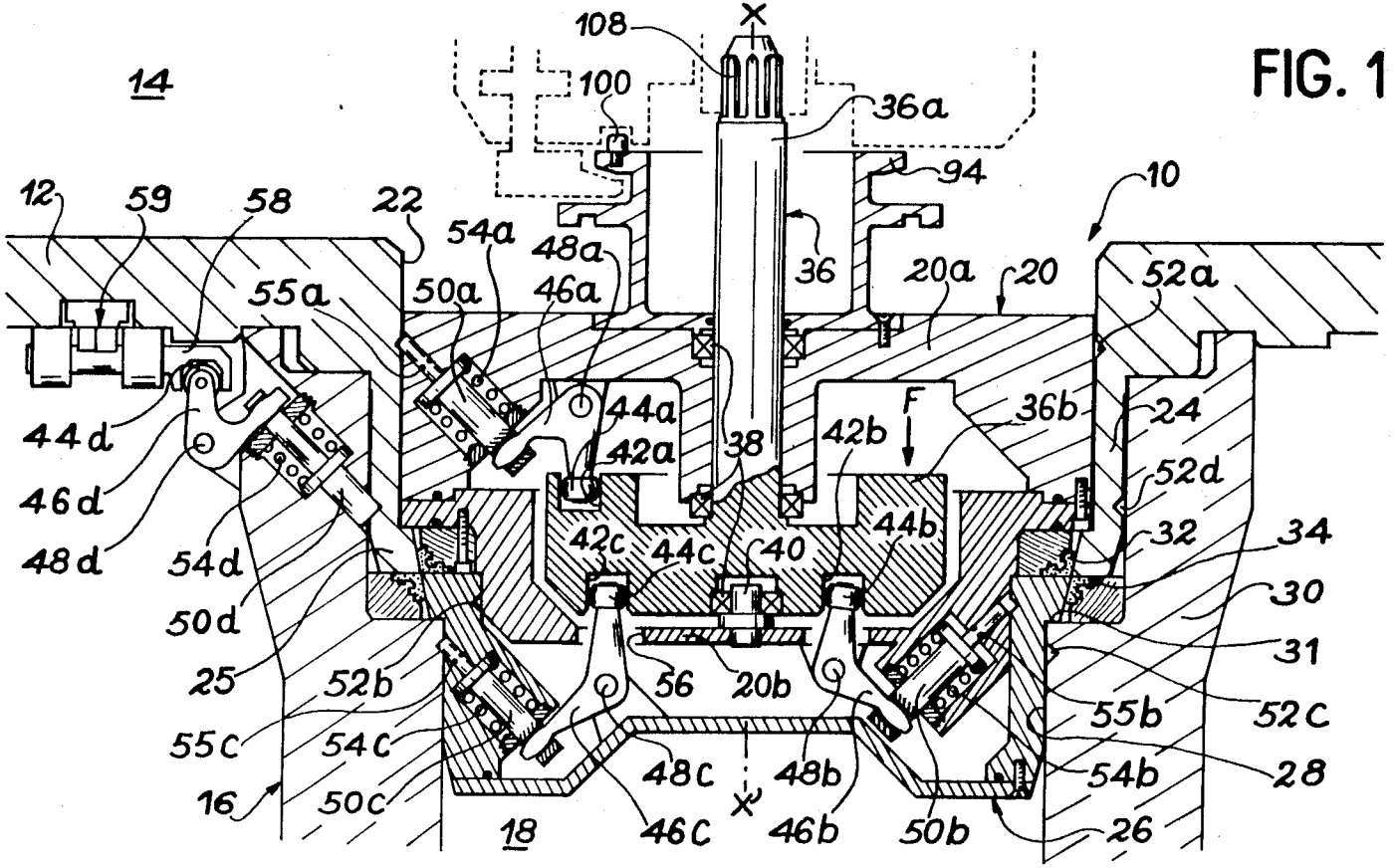
FIG. 1. A longitudinal sectional view of a tight connection device constructed in accordance with the invention.

In the embodiments shown in the drawings, the connection device 10 according to the invention is positioned between a static enclosure 12 defining an internal working volumn 14 of relatively large dimensions and a mobile container 16 defining an internal volume 18 of relatively small dimensions. Only those parts of the enclosure 12 and container 16 containing the connection device 10 are shown in FIG. 1.

In known manner, the connecting device 10 comprises a first door 20, which tightly closes a circular opening 22 formed in a flange 24 integeral with the wall of enclosure 12. In a comparable manner, the device 10 comprises a second door 26 tightly closing a circular opening 28 formed in a flange 30 integeral with the wall of container 16.

More specifically, the flange 24 of enclosure 12 is in the form of a skirt, which projects to the outside of the enclosure and on which can be mounted the end of the flange 30 of container 16. Thus, flanges 24 and 30 respectively constitute an internal flange and an external flange. In order to permit the fitting of the internal flange 24 in the end of flange 30, door 26 is set back into the interior of the latter. For this purpose, door 26 has an external collar, which bears on a shoulder 31 formed on opening 28. The dismantling of door 20 takes place towards the inside of enclosure 12, and inner collar 25 also being formed at the end of flange 24 to serve as an abutment for door 20.

In known manner, door 20 supports on its periphery an annular joint 32 made from an elastomer material, whose frustum-shaped, outer peripheral surface normally tightly bears against a complementary surface formed within collar 25. Another active face of joint 32 is normally located in the same radial plane as the planar end face of flange 24, when door 20 is locked in the latter.

In a comparable manner, an O-ring 34 made from an elastomer material is fixed within the container flange 30 and bears against shoulder 31. The frustum-shaped, inner, peripheral face of O-ring 34 is normally in tight contact with a complimentary surface formed on the periphery of door 26. Moreover, another active face of O-ring 34 is normally positioned in the same radial plane as the planar end face of door 26, when the latter is locked within flange 30.

As is illustrated by FIG. 1, when the container flange 30 is mounted on the enclosure flange 24, the planar end faces of these two flanges respectively bear on the active radial faces of joints 34 and 32. The active frustum-shaped faces of these joints are then located in the extension of one another. In this position, the circular openings 22 and 28 are aligned in accordance with the same axis XX'.

According to the invention, the locking and unlocking of the doors in the flanges corresponding thereto and the locking and unlocking of the doors with respect to one another are controlled by a member 36 mounted in rotary manner in door 20 about axis XX'. Member 30 comprises a control rod **36*a* completely traversing a first part 20*a* of door 20 located on the side of the inner volume 14 of enclosure 12. Rod 36*a* is supported in rotary manner by said door part 20*a* via bearings 38**.

Rod **36*a* is integral with a solid part 36*b* located within door 20 in a space formed between part 20*a* and a second part 20*b* of said door. Advantageously, said part 20*b* can have a centering pin 40 cooperating in rotary manner with the solid part 36*b* via a third bearing 38**.

Figure 2:
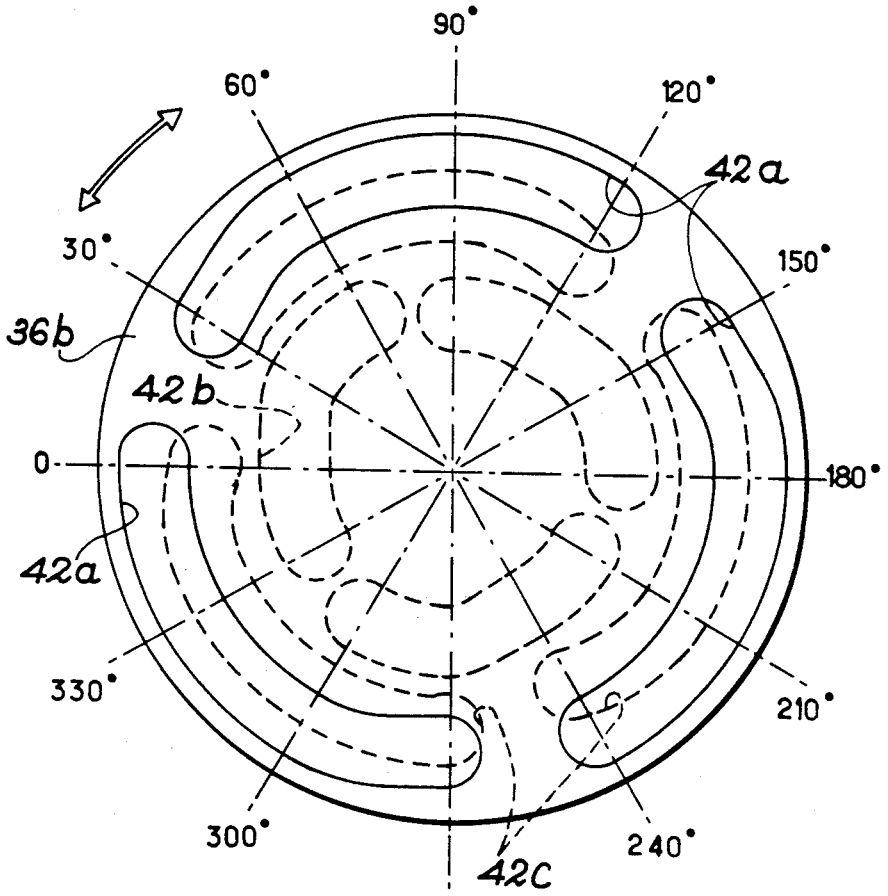
FIG. 2. A view in accordance with arrow F in FIG. 1 of the control member in which are formed the cam surfaces for controlling the locking and unlocking of the device.

So that, during its rotation, it controls the locking and unlocking of the doors with respect to one another and to the flanges corresponding thereto, the solid part **36*b* has three series of cam surfaces constituted by slots 42*a*, 42*b* and 42*c*, which essentially have a circular arc configuration. As illustrated by FIGS. 1 and 2, each series of slots comprises three slots regularly distributed about axis XX', each slot having a length corresponding to a rotation of approximately 90° of part 36*b***.

The part forming the cam is limited to approximately 30° on said circular arc of 90°. In other words, the radius of the slots of a given series is constant on a circular arc of approximately 60° and varies over a circular arc of approximately 30°. Moreover, the parts forming the cam of each series of the slots **42*a*, 42*b* and 42*c* are displaced with respect to the parts forming the cam of the other series, in such a way that the rotation of member 36** has the effect of successively controlling each of the locking means of the device. A sequential control of these locking means is consequently obtained.

In practice, the first series of slots **42*a* is formed on the planar face of part 36*b* turned towards part 20*a* of door 20, whilst the second and third series of slots 42*b* and 42*c* are formed on the planar face of part 36*b* turned towards part 20*b* of door 20**.

Each of the series of slots forming cams **42*a*, 42*b* and 42*c* controls a series or set of three bolts 50*a*, 50*b* and 50*c* respectively ensuring the locking of door 20 to flange 24, door to door 26 and door 26 to flange 30. The three bolts each bolt series 50*a*, 50*b* and 50*c*** are regularly distributed at 120° with respect to one another about axis XX'.

The three bolts **50*a* ensuring the locking of door 20 to flange 24 are slidingly mounted in part 20*a* of door 20, so that they move between an unlocking or open position in which their end is retracted and is flush with the outer peripheral surface of door 20 and a locking for closed position in which the end of the bolts project beyond said surface into an annular groove 52*a* formed within flange 24**.

In a comparable manner, the three bolts **50*b* ensuring the locking of door 20 to door 26 are slidingly mounted in part 20*b* of door 20, so as to move between an unlocking or open position in which their end is retracted and is flush with part of the outer peripheral surface of door 20 penetrating an annular part of door 26 and a locking or closed position in which the end of the bolts project beyond said surface into an annular groove 52*b* formed within the annular part of door 26**.

In the same way, the three bolts **50*c* ensuring the locking of door 26 to flange 30 are slidingly mounted in the annular part of door 26, so as to move between an unlocking or open position in which the end is retracted and flush with the outer surface of said annular part and a locking or closed position in which the end of the bolts projects beyond said surface into an annular groove 52*c* formed within flange 30**. The displacement of each of the bolts takes place in a radial plain passing through axis XX'.

Each of the bolts **50*a*, 50*b* and 50*c* is elasticly drawn towards its locking position by a compression spring 54*a*, 54*b* and 54*c*** respectively.

Moreover, the seal of doors 20 and 26 is maintained by O-rings (or bellows) **55*a*, 55*b* and 55*c* respectively placed between each of the bolts 50*a*, 50*b* and 50*c*** and the door in which it slides.

Preferably, in order to improve the resistance of the device according to the invention to high forces applied along axis XX' in the opening direction of doors 20 and 26 considered in isolation or in the separation direction of said two doors when they are locked by bolts **50*b*, bolts 50*a*, 50*b* and 50*c* are inclined by an angle of approximately 45° in the direction opening said opening or said separation. In the embodiment of FIG. 1 in which the opening and separation of the doors takes place towards the inside of enclosure 12, bolts 50***a*, 50*b* and 50*c* are consequently inclined by approximately 45° towards the interior of said enclosure and with respect to axis XX'.

In view of the fact that the end of the bolts 50*a*, 50*b* and 50*c* able to project into grooves 52*a*, 52*b* and 52*c* respectively is in the form of a cylindrical rod with a chamfered end, the grooves 52*a*, 52*b* and 52*c* then have triangular shapes in section.

In order to move bolts 50*a*, 50*b* and 50*c* between the locking and unlocking positions, between each of the slots forming the cam 52*a*, 52*b* and 52*c* and the corresponding bolt is placed a movement transmission member 46*a*, 46*b* and 46*c* respectively.

Each of the members 46*a*, 46*b* and 46*c* is in the form of a lever with two V-shaped branches mounted so as to pivot in its median part on a spindle 48*a*, 48*b* and 48*c* respectively, positioned in a direction orthogonal to axis XX'. Levers 46*a* and 46*b* are respectively supported in a pivotal manner by parts 20*a* and 20*b* of door 20, whereas levers 46*c* are supported in a pivotal manner by door 26.

A first branch of each of the levers 46*a*, 46*b* and 46*c* is oriented substantially parallel to axis XX' and carries at its end a roller 44*a*, 44*b* and 44*c*, which is located in the corresponding cam-forming slot 42*a*, 42*b* and 42*c*. As illustrated in FIG. 1, holes 56 formed in part 20*b* of door 20 permit the passage of the first branch of each of the levers 46*b* and 46*c*.

The second branch of each of the levers 46*a*, 46*b* and 46*c* is oriented in a direction substantially perpendicular to the bolt 50*a*, 50*b* and 50*c* corresponding thereto. The end of each of these two branches forms two opposite convex bearing surfaces which cooperate in a positive manner, in both directions, with the edges of a notch formed in the correspnding bolt, so as to induce an axial displacement of the latter under the effect of the pivoting of the lever.

In the case where the bolts 50*a*, 50*b* and 50*c* are inclined by approximately 45° degrees towards the inside of enclosure 12, the two branches of each of the three levers 46*a* form between them an angle of approximately 45°, whereas the two branches of each of the levers 46*b* and 46*c* form between them an angle of approximately 135°.

As a result of the structure hereinbefore, the locking and unlocking operations of the doors to one another and to the flanges are carried out without any rotation with respect to the joints, which makes it possible to maintain the satifactory operation thereof even in the case of intense use. Moreover, the design of the locking mechanism is such that the device remains reliable, even when it has a large size and is subject to high axial forces and stresses.

Moerover, the embodiment described hereinbefore has the additional advantage of providing a sequential control of the different loOking and unlocking operations. Thus, the particular arrangement of the cams shown if FIG. 2 makes it possible, after engagement, to successively control during the rotation of member 36 the locking of the container door 26, then the locking of door 20 on door 26 and finally the unlocking of door 20 from the enclosure. In another, not shown configuration, the first two operations could be reversed by a simple modification to the cam surfaces formed by slots 42*a*, 42*b* and 42*c*. Obviously, the sequential character of the operations then occurs in the reverse order on disengaging the container from the enclosure. It has the advantage that the exact configuration of the device is known at all times.

In the embodiment shown in FIG. 1, the device also comprises means for locking the flange 30 of container 16 to flange 24 of enclosure 12.

The latter means are realised in an identical manner to the other locking means. They have at least three bolts 50*d*, arranged at 120° from one another about axis XX'. These bolts are mounted slidingly in flange 30, so that they can move between an unlocking position in which they are retracted and flush with the inner peripheral face of flange 30 and a locking position in which they project beyond said periphery into an annular groove 52*d* formed in the outer periphery of flange 24. The displacement direction of each of the bolts 50*d* is contained in a plane passing through axis XX' and is preferably inclined by 45° with respect to said axis towards the inside of enclosure 12, so as to oppose any force tending to separate the container 16 from enclosure 12. To take account of the slope of the bolts 50*d*, the annular groove 52*d* has a triangular section. A spring 54*d* moves each of the bolts 50*d* towards its locking position.

The control of the displacement of each of the bolts 50*d* takes place via a V-shaped lever 46*d*, whereof the central part is articulated on flange 30 by a spindle 48*d*. A first branch of each of the levers 46*d* is positioned substantially parallel to axis XX' and carries at its end a roller 44*d*, which is placed in a control fork 58 supported by the wall of enclosure 12 when container 16 is engaged on the latter.

The second branch of each of the levers 46*d* is positioned substantially perpendicularly to the corresponding bolt 50*d* and its end has two opposite convex surfaces, which bear on the edges of a notch formed in said bolt. The tilting of th levers 46*d* about their spindles 48*d* consequently has the effect of displacing bolts 50*d* between there locking and unlocking positions.

The control of this tilting is obtained by moving the forks 58 in a radial direction with respect to axis XX'. This displacement of forks 58 can be realised by any means and particularly with the aid of a rotary cam 59 actuated by a not shown jack. Thus, the bolts 50*d* are simultaneously controlled.

When this is made possible by the dimensions and weight of the doors, the manipulation of member 36 controlling the locking means can be simply carried out with the aid of a wheel or a lever fixed to the end of shaft 36*a* located within enclosure 12.

Figure 3:
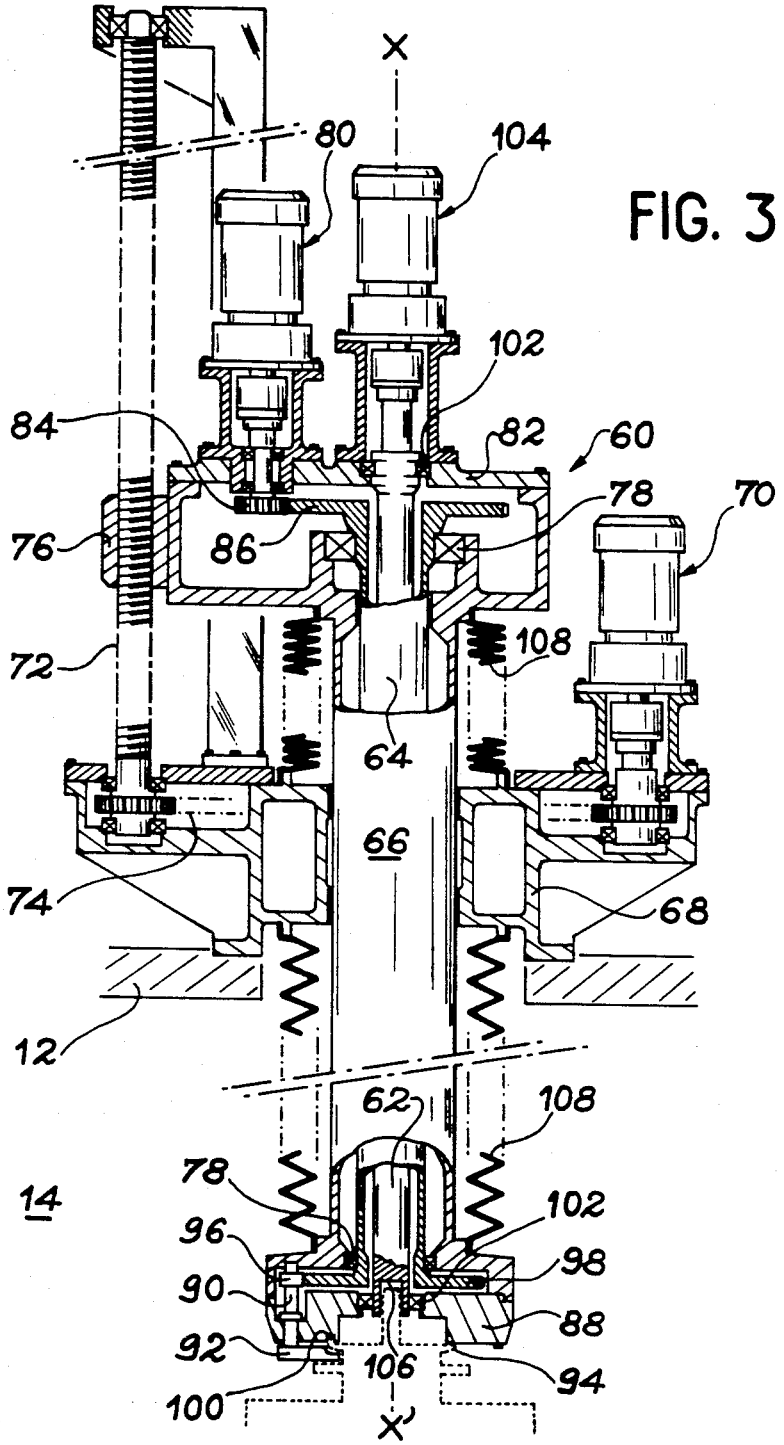
FIG. 3. A side view, in partial longitudinal section, of an installation used for the remote manipulation of the device according to FIG. 1, as well as for ensuring the gripping and handling of its double door.

In the represented embodiment, the member 36 is remotely manipulated with the aid of a device 60 permanently located within enclosure 12 and which also ensures the gripping and handling of the double door constituted by doors 20 and 26 when they are locked to one another. This device 60 will now be described with reference to FIG. 3.

The manipulating device 60 essentially comprises a central rod 62, an intermediate tube 64 and an external tube 66 arranged coaxially along axis XX' within volume 14. In the embodiment shown in FIG. 3, these three coaxial parts traverse the partition of enclosure 12 facing opening 22 closed by door 20, so that the motors and mechanisms ensuring the control of these three parts are positioned outside enclosure 12, which facilitates their maintenance.

More specifically, the external tube 66 slidingly traverses parallel to axis XX' a support part 68 fixed to the wall of enclosure 12 outside the same. The support part 68 carries a first geared motor means 70, which rotates a worm 72 having an axis parallel to the axis of tube 66, via a transmission chain 74 or some equivalent mechanism. A nut 76 integral with the end of tube 66 placed outside enclosure 12 is mounted on worm 72. Thus, the putting into operation of the geared motor means 70 has the effect of moving the external tube 66 parallel to axis XX' in one or other direction.

The intermediate tube 64 is supported in a rotary manner within tube 66 via bearings 78. The rotation of tube 64 within tube 66 is carried out by a second geared motor means 80 mounted on a plate 82 fixed to the end of tube 66, positioned outside enclosure 12. To this end, the output shaft of the geared motor means 80 carries a pinion 78, which meshes on a rack 86 integral with the end of tube 64, positioned outside enclosure 12.

At its lower end, tube 66 supports a gripping head 88. This head 88 is provided in its peripheral part with three spindles 90 parallel to axis XX' and carrying at there ends latches 92, which can be placed in a gripping ring 94 (FIG. 1) formed for this purpose on part 20*a* of door 20. Each of the spindles 90 carries a pinion 96, which meshes on a rack 98 integral with the lower end of tube 64. Thus, the putting into operation of the geared motor means 80 has the effect of moving latches 92 between a gripping position in which they located below ring 94 and a rest position where they are disengaged from said ring.

A centering pin (FIG. 1) is is mounted on ring 94 and located in a corresponding recess formed in the gripping head 88.

Shaft 62 is supported in rotary manner by plate 82 and by gripping head 88, via two bearings 102. A third geared motor means 104 supported by plate 82 directly engages on the end of shaft 62, positioned outside enclosure 12. The opposite end of shaft 62 has a grooved bore 106, which can be mounted on complementary grooves 108 (FIG. 1) at the end of rod 36*a* of control member 36. Thus, the geared motor means 104 controls the rotation of the control member 36 and consequently the locking and unlocking of the doors with respect to one another and to the flanges.

Preferably, sealing bellows 108 are tightly fixed between each of the ends of the external tube 66 and supports 68, so as to prevent any break in the confinement of enclosure 12 at this point.

In its rest position, device 60 is placed in the retracted position under the action of the geared motor means 70. Gripping head 88 is then placed in the immediate vicinity of the wall of enclosure 12 to which is fixed support 68.

When a container is engaged on the enclosure, it is firstly joined thereto by actuating the locking bolts 50*d* (FIG. 1). The gripping head 88 is then brought into the working position by putting into action the geared motor means 70. In this position, shown in FIG. 3, the putting into action of the geared motor means 80 has the effect of tilting the latches 92, Thus ensuring the gripping of the double door. The opertion of unlocking the two doors relative to their flange and the operation of locking plugs to one another are then carried out by actuating the geared motor means 104. The opening of the double door can then be carried out by again actuating in the reverse direction the gear motor means 70. When it is wished to separate the container from the enclosure, the aforementioned operations are performed in the reverse direction.

Obviously, the invention is not limited to the embodiment described hereinbefore and in fact covers all variants thereof. In particular and as mentioned herein before, the manipulation of member 36 can be carried out directly with the aid of a wheel or lever integral therewith. In the same way, the means for joining each of the flanges can differ from those described and it is obvious that the invention is not only applicable to the engagement of a container on an enclosure and in fact covers in general terms the connection of enclosures of random types and sizes. Finally, the transmission of the movements between the cam surfaces formed on the control member and the bolts ensuring the locking operations can be carried out by any means equivalent to the aforementioned V-shaped levers.

What is claimed is:

1. A device for the tight connection of a first enclosure having a first flange forming an opening normally closed by a first door to a second enclosure having a second flange forming an opening normally closed by a second door, said device having means for locking the doors to the flanges and the doors to one another, wherein the locking means comprise at least one control member supported in a rotary manner by the first door and having at least three cam surfaces; a first set of at least three bolts and a second set of at least three bolts able to slide in the first door between a retracted position and a locking position in which said bolts project into recesses respectively formed in the first flange and in the second door; a third set of at least 3 bolts able to slide in the second door between a retracted position and a locking position in which said third set of bolts projects into a recess formed in the second flange; and three sets of at least three transmission members respectively placed between each cam surface and one of the sets of bolts for moving the latter between their retracted and locking positions under the effect of a rotation of the control member.

2. A device according to claim 1, wherein each of the bolts is mobile in a direction located in a plane containing the rotation axis of the control member and inclined in the direction aiding the sealing of the doors.

3. A device according to claim 1, wherein preferably, each of the transmission members comprises a v-shaped lever articulated about an axis orthogonal to the rotation axis of the control member and whereof one end bears on one of the cam surfaces and whereof the opposite end bears on one of the bolts, the levers bearing on the first and second sets of bolts being articulated on the first door, whilst the levers bearing on the third set of bolts are articulated on the second door.

4. A device according to claim 1, wherein the device also having means for locking the flanges together, said means having at least one fourth set of at least three bolts able to slide in the external flange between a retracted position and a locking position in which the fourth set of bolts projects into a recess formed in the internal flange, and means for displacing said fourth set of bolts between its retracted position and its locking position.

* * * * *